United States Patent [19]

Ackerman et al.

[11] 4,360,945

[45] Nov. 30, 1982

[54] ROLLER SUPPORTING MEANS FOR LONG RETRACTING SOOT BLOWERS

[75] Inventors: Dean C. Ackerman; Charles W. Hammond, both of Lancaster, Ohio

[73] Assignee: The Babcock & Wilcox Company, New Orleans, La.

[21] Appl. No.: 281,089

[22] Filed: Jul. 7, 1981

[51] Int. Cl.[3] ..... F23J 3/02

[52] U.S. Cl. ..... 15/316 R

[58] Field of Search ..... 15/316 R, 316 A, 317, 15/318

[56] References Cited

U.S. PATENT DOCUMENTS

| | | | |
|---|---|---|---|
| 3,216,045 | 11/1965 | McColl | 15/317 |
| 3,604,050 | 9/1971 | Nelson et al. | 15/317 |
| 4,207,648 | 6/1980 | Sullivan et al. | 15/316 R |

*Primary Examiner*—Chris K. Moore

*Attorney, Agent, or Firm*—Harness, Dickey & Pierce

[57] ABSTRACT

Roller supporting means for the lance tube of a long travel retracting soot blower includes a pair of castering-type roller assemblies having their castering axes non-vertical. Each roller assembly is counterweighted to such extent as to substantially statically balance the assembly about its castering axis.

4 Claims, 4 Drawing Figures

FIG. 1.
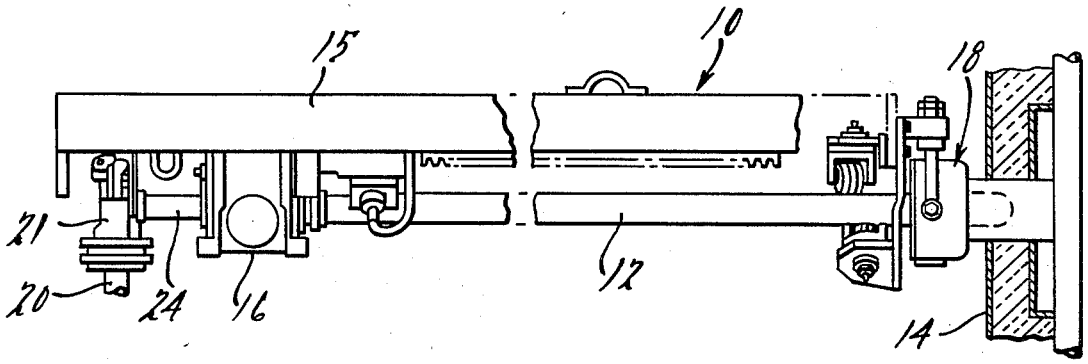
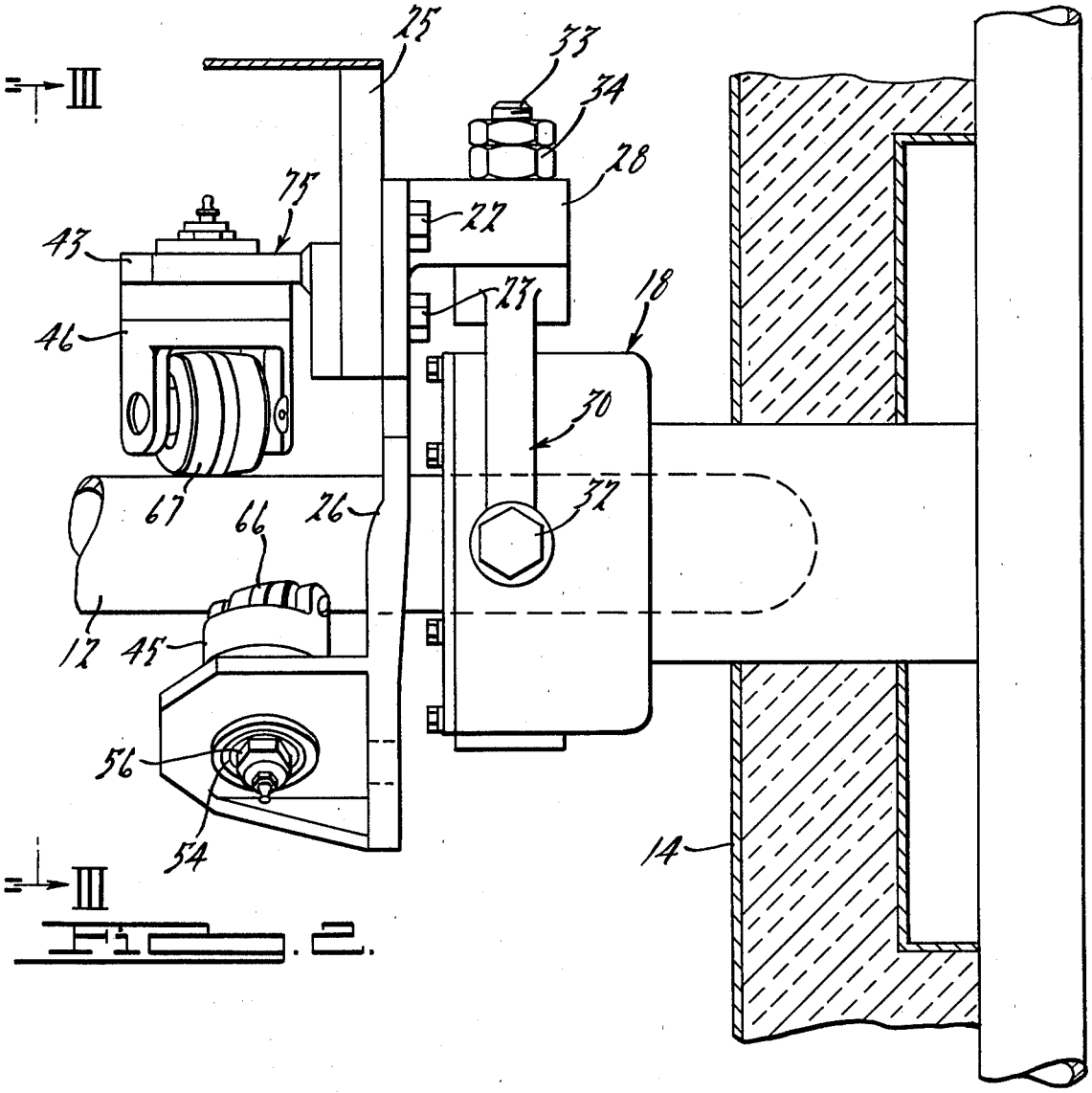
FIG. 2.

ROLLER SUPPORTING MEANS FOR LONG RETRACTING SOOT BLOWERS

BACKGROUND OF THE INVENTION

The lance tubes of long retracting soot blowers are, in common practice, provided with supporting rollers at a location close to the wall of the boiler or heat exchanger into which the lance tube is projected during cleaning operations. (See, for example, U.S. Pat. No. 3,585,673). When such blowers are so constructed that the lance tube rotates continuously in one direction while advancing, and rotates continuously in the opposite direction while retracting, the helix angle is the same in both directions of movement of the lance tube, and the rollers are typically fixed in such a position that they rotate on the helix line, that is, their axes are fixed in a position perpendicular to the helix line and tangent to a cylinder concentric with the helix. In order to support the lance tube properly, a plurality of rollers are used, including at least two located below and laterally of the axis of the lance tube.

Where the operation of the blower involves changing the helix angle during travel of the lance, as occurs in the operation of blowers having a lance tube which is oscillated about its longitudinal axis during its axial travel, an undesirable degree of sliding friction and resultant wear of the lance tube occur when such rollers are journaled on fixed axes in the manner indicated above. The present invention has as its overall objective the provision of improved roller supporting means which avoids sliding friction between the lance tube and the rollers despite changes of helix angle which occur during operation of the lance tube. A related object of the invention is to provide roller supporting means which is highly sensitive and quickly responsive to changes and reversals of the helix angle, and in which the castering action is virtually unaffected by gravity.

Other objects and advantages of the invention will become apparent to persons skilled in the art upon consideration of the present disclosure in its entirety.

BRIEF DESCRIPTION OF THE FIGURES OF DRAWING

FIG. 1 is a somewhat diagrammatic side elevational view of a soot blower provided with roller supporting means embodying the present invention, the soot blower being centrally broken away, and a portion of a boiler wall being illustrated in section;

FIG. 2 is a view on a larger scale of the supporting roller and wall box area and adjacent portions of a furnace wall;

DETAILED DESCRIPTION OF PREFERRED FORM OF THE INVENTION

Figure 3:
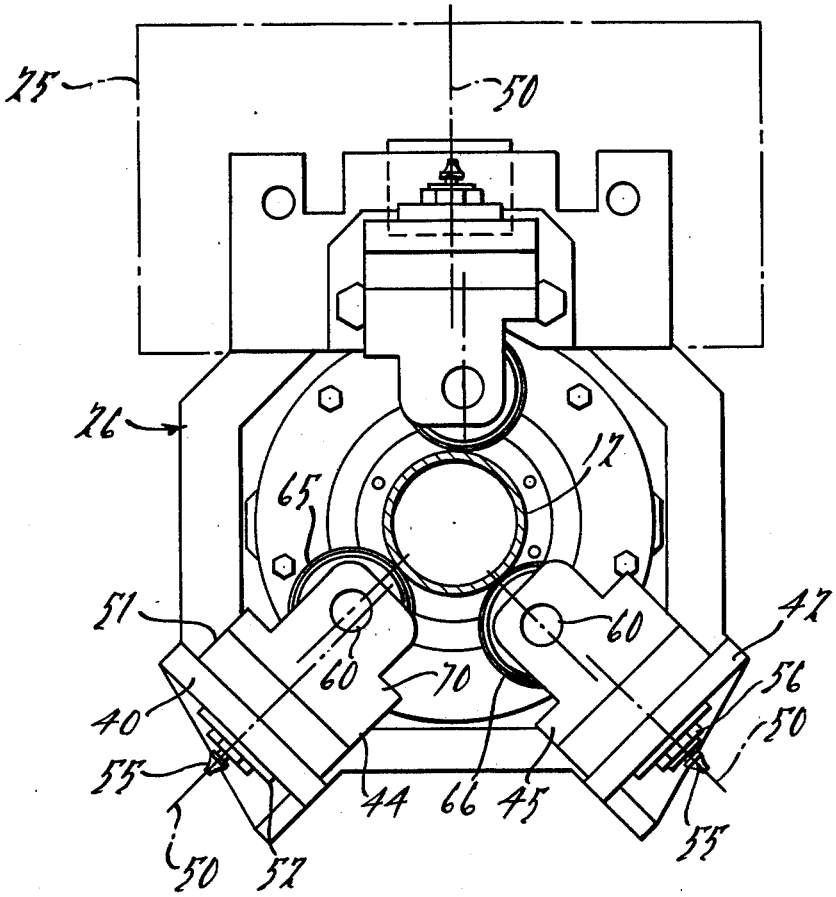
FIG. 3 is a cross-sectional view taken substantially on the line III—III of FIG. 2 and looking in the direction of the arrows.
Figure 4:
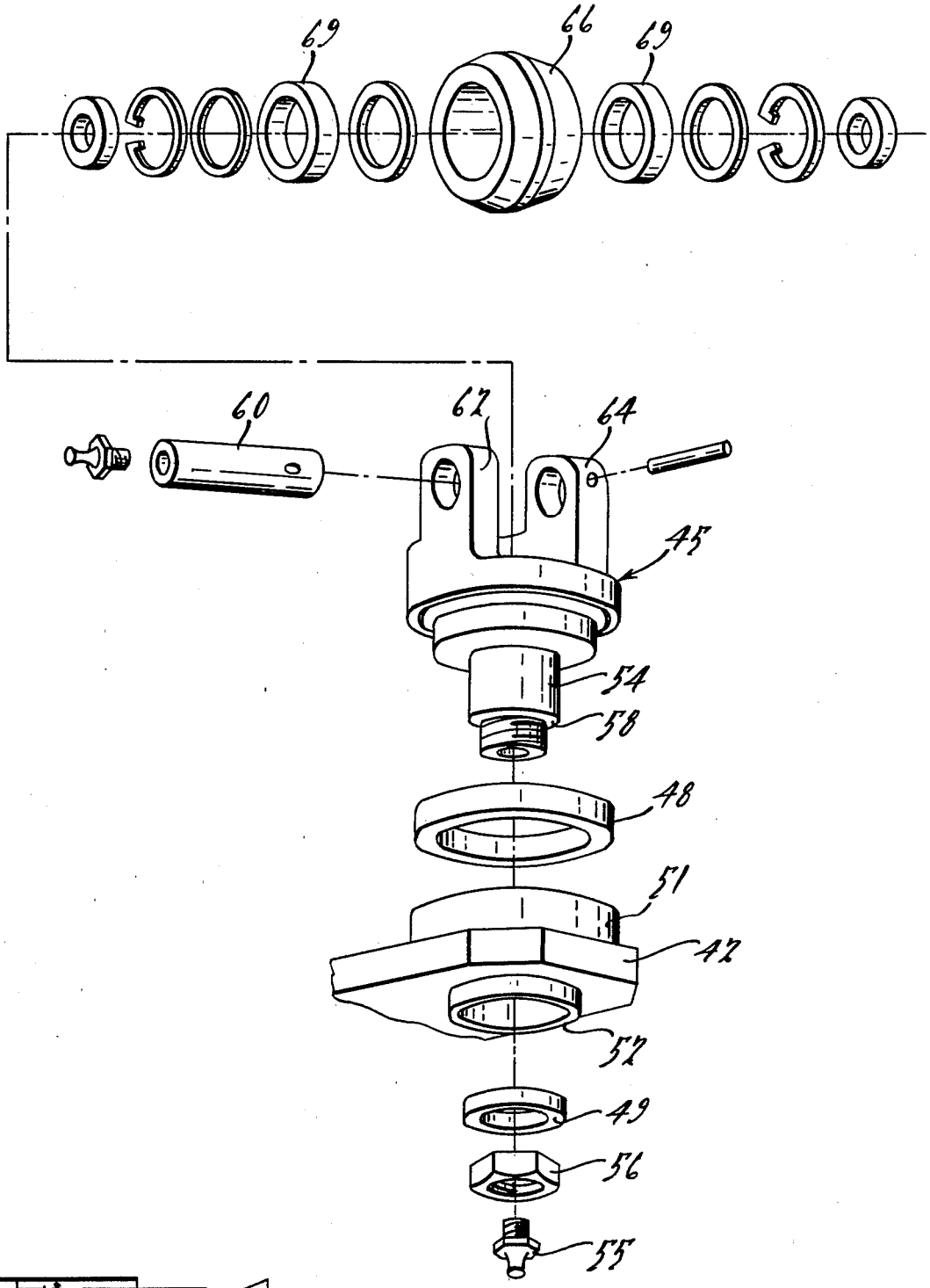
FIG. 4 is an exploded perspective view of one of the roller assemblies.

Referring now to the drawing, reference character 10 designates generally a long-travel soot blower of the well known IK-type, having a lance tube 12 projectable into the interior of a boiler, or other exchanger, within which surfaces are to be cleaned by the blower. The supporting means includes a beam structure 15 containing supporting tracks (not shown) along which a carriage 16 is rollable, the carriage being effective to actuate the lance tube 12 both rotationally and longitudinally to project it through the wall 14 into, and retract it from the interior of the heat exchanger. (A boiler being fragmentarily shown as typifying the environment wherein such blowers are employed.) The orifice means through which the lance tube moves may typically include an air cooled wall box assembly 18. A cleaning fluid is discharged from the lance tube 12 during its progress inside the heat exchanger, being fed thereto via supply pipe 20, blow valve 21 and a feed tube 24 which projects into the lance tube and upon which the latter is slidably overfitted. The beam 15 is supported by suitable structural elements (not shown) outside the boiler wall.

The components above described will be recognized as conventional and well known. It is also common to provide, usually supported by the front bulkhead 25 of the beam 15 of the blower, roller means upon which the lance tube is rollably supported. A support 26, which may be formed as a weldment, is secured as by cap screws 22, 23 to a bulkhead 25. An arm 28 projecting forwardly from the top of support 26 supports a depending yoke 30 having bifurcated arms to which the wall box 18 is trunnioned as by trunnion screws 32. The threaded supporting stem 33 of yoke 30 projects upwardly through the arm 28, its upper extremity being fitted with a pair of jam nuts 34 by which it is secured to the support weldment 26.

As best shown in FIG. 3, the support weldment 26 extends downwardly in the form of a loop around and below the lance tube 12. The loop formed by the support 26 is of generally octagonal shape having at each of its two lower corners a rigid rearwardly projecting shelf bracket which is flat and in each instance arranged on a plane perpendicular to a line radial with respect to the axis of the lance tube 12 and at about 45° to the horizontal. Each of the two shelf brackets 40, 42 carries a roller support or carrier 44, 45, journaled as by means including antifriction bearings 48, 49 above and below its shelf bracket in such manner as to be swingable about a castering axis 50, radial with respect to the lance tube. The bearings 48, 49 are closely surrounded by walls 51, 52 which project from the shelf brackets 40, 42 and assist in shielding the bearings against contamination. Stub shafts 54 integral with the roller carriers project downwardly through the shelf brackets and below the latter, where they carry lubricant fittings as 55 and are secured as by a nut 56 which when tightened, reacts through the lower bearing 49 against a thrust shoulder 58 on the carrier stub shaft to secure the carrier and permit the swinging movement thereof about the castering axis.

Spaced sidearm portions as 62, 64 of the carriers support rollers as 65, 66 journaled therein on roller shafts as 60 by means of antifriction bearings 69. The axes of the roller shafts are laterally offset from the caster axis 50, as shown in FIG. 3. By virtue of such offset, it will be recognized that due to the well known castering effect, rotation of the lance tube concurrently with longitudinal movement thereof will tend to cause the roller carriers to turn to positions such that shafts 60 are perpendicular to the helix line traced by a point on the lance tube. The roller paths thus tend to follow the helix line without the occurrence of sliding friction between the rollers and the lance tube. Due to the fact that the castering axes are at an angle to the vertical, however (approximately 45°) the mass of the offset roller, shaft and related parts tends to turn the carriers toward positions in which the roller shafts 60 are horizontal, opposing the castering effect and tending to prevent the rollers from turning about the castering axis to a position conforming to the helix angle.

In order to eliminate the effect of gravity on the castering action, counterweight masses sufficient to statically balance the carrier/roller assembly with respect to the castering axis are incorporated in each of the carriers on the side opposite that to which the roller axes are offset. Such counterweight masses are formed by a wall portion as 70 integral with and interconnecting the two side arm portions 62, 64 and looped around the roller. By virtue of the counterbalancing effect of the mass provided in the wall areas 70, the castering action is uninfluenced by gravity despite the angular positioning of the helix angle of rollers 65, 66, and as the helix angle changes during operation of the blower, the rollers remain in positions to track accurately and roll without sliding friction on the helical path.

As mentioned previously, a top roller is frequently desirable to prevent upward displacement of the lance tube. In the preferred construction illustrated, an upper roller assembly is shown carried by a separate shelf bracket structure 75 secured by the screws 23 to the inner wall of the bulkhead 25. The shelf portion 43 of shelf bracket structure 75 is horizontal, in normal installations, and inasmuch as gravity has no effect on the castering action of the top roller so mounted, no counterweight means is necessary. However, it will be noted that with such mounting of the top roller, the presence of the counterweight has no effect on the action of the roller, and therefore, in the interests of standardization, efficiency and avoidance of errors in assembly, servicing, etc., we prefer to utilize identical carrier and roller means in such top positioning. The top carrier is designated 46. Its roller 67, as well as the roller 66 are shown in FIG. 2 as turned to a hypothetical helix angle, although in FIG. 3 for clarity of illustration the rollers are shown at a zero helix angle, that is, with their roller axes parallel to the lance tube axis. Although they pass through such a position during helix angle reversals, they would of course not remain in such a position during operation of the blower.

This detailed description of a preferred form of the invention, and the accompanying drawings, have been furnished in compliance with the statutory requirements to set forth the best mode contemplated by the inventors of carrying out the invention. The prior portions consisting of the "Abstract of the Disclosure" and the "Background of the Invention" are furnished without prejudice to comply with administrative requirements of the Patent and Trademark Office.

While a preferred form of the invention has been illustrated and described, it will be recognized that changes may be made within the fair and reasonable scope of the appended claims without departing from the properly patentable scope of the invention.

We claim:

1. In a soot blower having a lance tube which is movable both axially and angularly simultaneously, a plurality of castering-type roller assemblies for journaling and positioning the lance tube with respect to a desired path of movement, each assembly comprising a roller carrier, means journaling the carrier for swinging movement about a castering axis, and a roller journaled in the carrier on a roller axis displaced laterally from the castering axis and rollably engaging the lance tube.

2. A combination as defined in claim 1 characterized in that the assembly is substantially statically balanced about said castering axis.

3. A combination as defined in claim 2 wherein the castering axes are non-vertical.

4. A combination as defined in claim 2 wherein the path of movement of the lance tube is substantially horizontal and the castering axes are non-vertical.

* * * * *